US006030120A

United States Patent [19]

Fox et al.

[11] Patent Number: 6,030,120

[45] **Date of Patent: *Feb. 29, 2000**

[54] PRODUCE BAG WITH IMPROVED WICKET FEATURES

[75] Inventors: Kenneth S. Fox; L. Keith Fox, both of McAllen, Tex.

[73] Assignee: Kenneth Fox Supply Co., McAllen, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/174,435

[22] Filed: Oct. 16, 1998

[51] Int. Cl.[7] ..... B65D 30/06

[52] U.S. Cl. ..... 383/9; 206/554; 383/117

[58] Field of Search ..... 383/9, 117; 206/554

[56] References Cited

U.S. PATENT DOCUMENTS

| | | | |
|---|---|---|---|
| 1,822,948 | 9/1931 | Armstrong . | |
| 1,906,500 | 5/1933 | Twitchell . | |
| 2,085,365 | 6/1937 | Israel | 383/117 |
| 2,128,658 | 8/1938 | Millett . | |
| 2,428,266 | 9/1947 | Daniels . | |
| 2,646,203 | 7/1953 | Brady . | |
| 2,774,402 | 12/1956 | Wikle . | |
| 2,853,225 | 9/1958 | Bauer . | |
| 2,952,397 | 9/1960 | Doyle . | |
| 3,123,279 | 3/1964 | Day | 383/117 |
| 3,257,915 | 6/1966 | Cartier et al. | 383/117 |
| 3,279,511 | 10/1966 | Griffin, Jr. . | |
| 3,554,368 | 1/1971 | Nagel | 383/117 |
| 3,721,603 | 3/1973 | Takeda . | |
| 3,733,024 | 5/1973 | Bolling, Jr. . | |
| 3,967,544 | 7/1976 | Brock et al. . | |
| 4,002,517 | 1/1977 | Mosley et al. . | |
| 4,207,983 | 6/1980 | Wolske | 383/117 |
| 4,301,961 | 11/1981 | Rodish . | |
| 4,386,924 | 6/1983 | Crawford et al. . | |
| 4,403,637 | 9/1983 | Sabater et al. | 383/9 |
| 4,451,249 | 5/1984 | DeBin . | |
| 4,491,217 | 1/1985 | Weder . | |
| 4,566,927 | 1/1986 | Wood . | |
| 4,832,677 | 5/1989 | Hudgens et al. . | |
| 4,881,933 | 11/1989 | Wech . | |
| 4,883,450 | 11/1989 | Benoit . | |
| 4,889,523 | 12/1989 | Sengewald . | |
| 4,974,968 | 12/1990 | Mandus et al. . | |
| 4,988,213 | 1/1991 | Mattle | 206/554 |
| 5,294,148 | 3/1994 | Imai . | |
| 5,417,638 | 5/1995 | Anderson et al. . | |
| 5,571,361 | 11/1996 | Stuerzel . | |
| 5,741,076 | 4/1998 | Cammack | 383/117 |
| 5,823,683 | 10/1998 | Antonacci et al. . | |

FOREIGN PATENT DOCUMENTS

| | | |
|---|---|---|
| 837421 | 6/1960 | United Kingdom . |

*Primary Examiner*—Stephen P. Garbe
*Attorney, Agent, or Firm*—Bracewell & Patterson, L.L.P.

[57] ABSTRACT

A produce bag having at least one side wall of a cross-laminated synthetic resin fabric mesh material is provided with increased strength and reliability for use with automatic bag filling equipment. The other wall is of a synthetic resin film, or of the same type of mesh material, if desired. A reinforcing strip of synthetic resin film is formed along an upper portion of a mesh material wall of the bag where spaced holes for wicket pin attachment are formed. The bag provides greater strength, uniformity, and reliability in automatic produce packing machine operations.

7 Claims, 3 Drawing Sheets

PRODUCE BAG WITH IMPROVED WICKET FEATURES

FIELD OF THE INVENTION

The present invention relates to wicket-top produce bags, and more particularly to bags adapted for automatic produce packing machines.

BACKGROUND OF THE INVENTION

Wicket produce bags have been developed for automatic produce packing machines. One portion of the bag has holes formed in it so that the bags can be suspended from wickets or pegs on an automatic packing machine. The earliest such bags were of polyethylene film.

Produce bags formed of a synthetic resin fabric mesh have been recently developed by the assignee of the present application, for example as described in co-pending U.S. patent application Ser. No. 08/888,175, filed Jul. 3, 1997. These bags were formed of a synthetic resin fabric mesh, such as the woven fabric of cross-laminated synthetic resin fibers known as Cross Laminated Airy Fabric or (CLAF) from Amoco Fabrics & Fibers, Inc. This fabric is an open mesh material of cross-laminated warp and weft strands or fibers of synthetic resin.

These types of bags are particularly useful for produce that must have access to fresh air to preserve the shelf life of the produce. However, when wicket holes are formed in this type of fabric mesh for automatic produce bag filling or packing machine purposes, problems have been found to occur. Slits were formed in the mesh in the area of the wicket holes leading away from the holes. The slits were formed in order to aid in tearing of the bag away from the packing machine once the bag was filled with product.

When the fabric mesh was slit for this purpose near the wicket holes, only a certain number of synthetic resin fiber strands in the fiber mesh were left uncut. The remaining uncut fiber strands were the sole support for the bag when it was suspended from the wicket rods or pegs and being filled with product. The number of strands left uncut was variable and indeterminate, and the reliability of the bags for use in automatic packing machines suffered. Bags with too many strands cut did not have adequate strength for use and would fall from the wickets during filling operations. Faulty bags could slow up operation of automatic packing machines by falling from the wickets when being filled with produce.

BRIEF SUMMARY OF THE INVENTION

Briefly, the present invention provides a new and improved wicket-top synthetic resin bag for use with wicket pins of automatic bag filling or packing equipment. The bag is formed of first and second side walls which are joined together along a bottom portion and two side edges. At least one of the side walls is formed from a cross-laminated synthetic resin fiber material mesh, such as a CLAF material or the like. The other of the side walls is formed of a synthetic resin film, such as polypropylene or polyethylene or the like. The other of the side walls may alternatively be formed of a synthetic resin fiber material mesh like the first one, if desired. The fiber mesh side wall or walls of the bag has a reinforcing strip of synthetic resin film extending along an upper edge. A wicket top is formed in the reinforcing strip for mounting the bag on the wicket pins of the bag packing machine or equipment.

Bags according to the present invention exhibit greater strength in use during filling operations and are thus more reliable. When one of the walls is of a polyethlyene film, the cost of the bags is also reduced.

BRIEF DESCRIPTION OF THE DRAWINGS

The objects, advantages and features of the invention will become more apparent by reference to the drawings appended thereto, wherein like numerals indicate like parts and wherein an illustrated embodiment of the invention is shown, of which.

DETAILED DESCRIPTION OF PREFERRED EMBODIMENT

Figure 1:
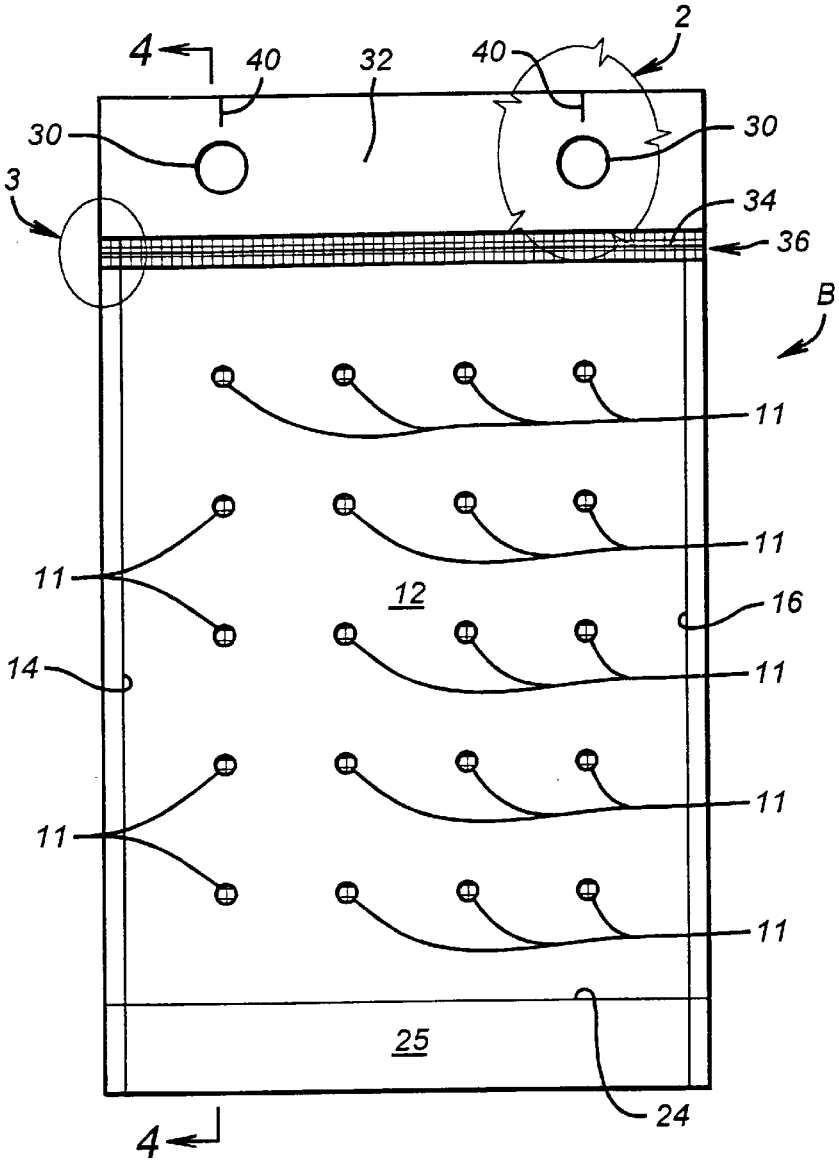
FIG. 1 is a front elevation view of a produce bag according to the present invention.

In the drawings, the letter B designates generally a wicket-top synthetic resin bag according to the present invention. The bag B is specifically adapted for use with wicket pins of commercially available automatic produce bag filling equipment. The following chart is a list of examples of bag filling equipment for which bags according to the present invention may be used:

| SOURCE | MODEL |
|---|---|
| Ag-Pak, Inc. | Double Ag-Pak Weigh/Bagger |
| Ag-Pak, Inc. | Octopak Rotary Bagger |
| Ag-Pak, Inc. | Mega Pak Bagger |
| Yakima Wire Works | MBU/9300 Automatic Poly Bagger |
| Spang & Brands | Automatic Weigher/Bagger |
| Automatic Bagging Systems, Inc. | Vindicator Bagger |
| Lockwood Packing Corp. | Carousel Bagger |
| Volm Bag Co. | VP10 & VP12 with carousel bagger |

Figure 6:
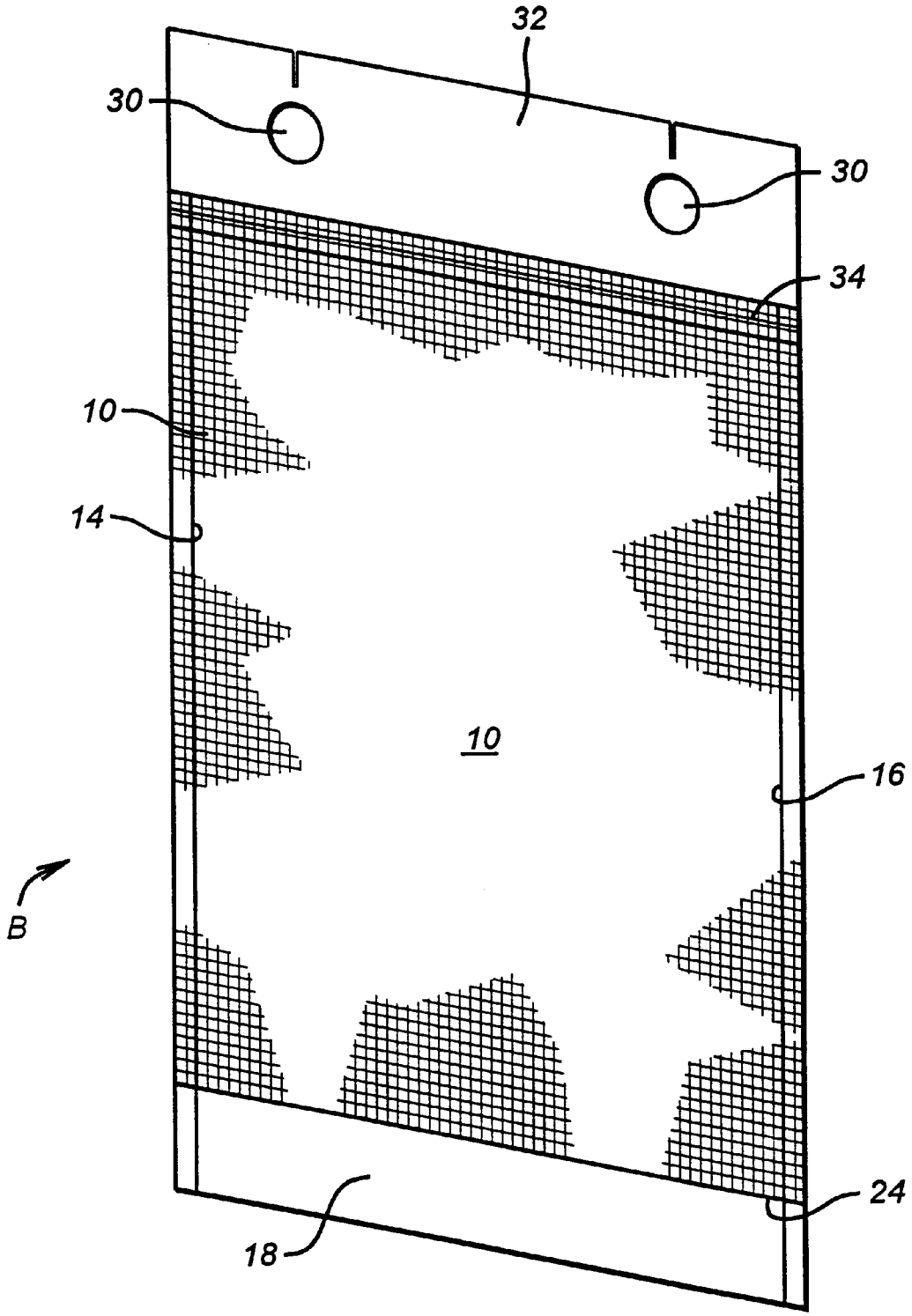
FIG. 6 is an isometric view of the bag of FIG. 1, taken from an opposite direction to that of FIG. 5.

The bag B has a first side wall 10 (FIG. 6), which is formed of a suitable synthetic resin fiber mesh. One type of such a mesh is the cross-laminated airy fabric material, or CLAF, available from Amoco Fabrics & Fibers, Inc. This type of fiber mesh or fabric is an open mesh material of cross-laminated warp and weft strands or fibers of a suitable synthetic resin.

A second side wall 12 of the bag B in the preferred embodiment is a suitable synthetic resin film, such as polyethylene or polypropylene, numerous types of which are commercially available. An example film is 2.25 mil MDPE with an EVA additive. Air or breather holes 11 may be formed in film 12, if desired. It should be understood that the second side wall 12 may also be alternatively formed of the same or similar open mesh cross-laminated material as the side wall 10, if desired.

The particular horizontal and vertical dimensions of the side walls 10 and 12, as well as their thickness, are determined based on the expected weight and size of produce to be packed into the bag B by automatic produce packing machinery. The chart below gives example sizes for bags intended for various produce weights:

| PRODUCE WEIGHT | BAG WALL DIMENSIONS |
|---|---|
| 2 pounds | 10 inches by 16 inches |
| 3 pounds | 10.5 inches by 16 inches |
| 5 pounds | 10.5 inches by 19 inches |
| 10 pounds | 13 inches by 23 inches |

For bags of these sizes, the reinforcing strip, discussed in more detail below, is typically 1.5" or so in height.

The bags B may be formed by hand or machines and preferably formed by machine. A suitable type of such machine has been manufactured by Hudson-Sharp Machine Co. of Green Bay, Wis.

The side walls 10 and 12 are bonded or sealed to each other along vertically extending side seams as indicated at 14 and 16. The joining of side walls 10 and 12 at the seams 14 and 16 may be done by any suitable bonding or sealing technique, such as heat, glue, sealant, or the like.

Figure 4:
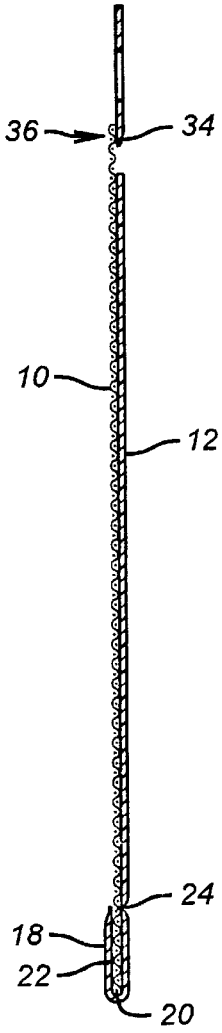
FIG. 4 is a cross-sectional view taken along the lines 4—4 of FIG. 1.
Figure 2:
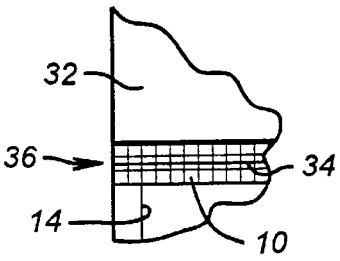
FIG. 2 is an enlarged view of a portion of the bag of FIG. 1 encircled and having reference numeral 2 indicating same.
Figure 3:
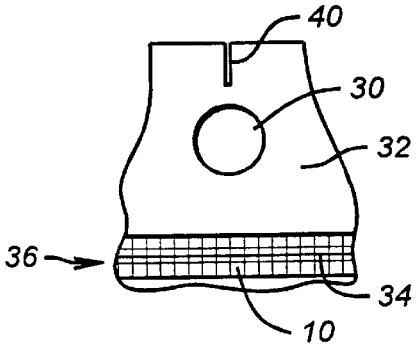
FIG. 3 is an enlarged view of a portion of the bag of FIG. 1 encircled and having reference numeral 3 indicating same.
Figure 5:
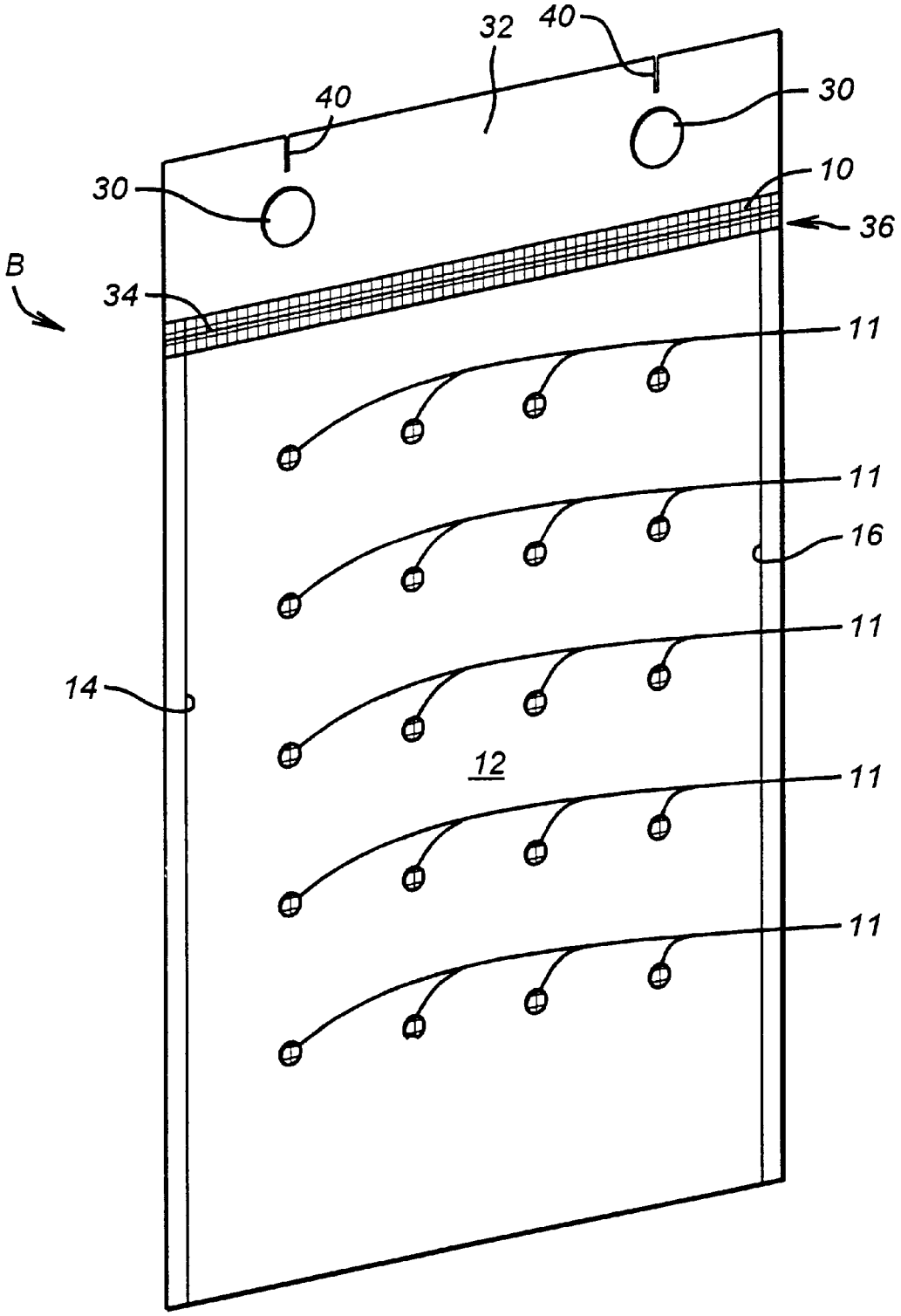
FIG. 5 is an isometric view of the bag of FIG. 1.

The second side wall 12 has a lower extension 18 (FIGS. 4 and 6) extending in vertical extent below the first side wall 10. The extension 18 is folded upwardly over a lower edge 20 (FIG. 4) of the first side wall 10. The extension 18 is then caused to lay against and extend upwardly along an outer surface 22 of the side wall 10 a suitable length depending on factors chosen by the produce packer.

The extension 18 may be several inches or so, providing an area 25 to which advertising or nutritional value information may be applied and displayed. If the area 25 is not needed, the extension 18 may be much smaller. In some situations, if desired, the extension 18 need not be present, and the side walls 10 and 12 joined by a seam at their lower edges.

When the extension 18 is present, three superimposed layers are formed (FIG. 4), two outer layers composed of the material of the second side wall 12, and an inner layer formed of the mesh material of the first side wall 10. The three superimposed layers of the side walls 10 and 12 are joined together, as indicated at 24 along a lower or bottom seam by bonding or sealing in the same manner as seams 14 and 16, described above.

The bag B is provided with a suitable number, usually at least two, of laterally aligned wicket holes 30 for suspension in an automatic produce packing machine so that the bag B may be filled with produce or product. The size of the wicket holes is based upon the produce packing machine with which the bags B are to be used.

According to the present invention, a reinforcing strip 32 of a suitable synthetic resin film is bonded or sealed, as indicated at 34, to form a laterally extending seam at an upwardly extending portion 36 of the mesh material of the first side wall 10. Joining of the strip 32 to the side wall 10 at the seam 34 may be done in accordance with the bonding or sealing techniques previously described. The synthetic resin film of the reinforcing strip 32 may be of the same or similar synthetic resin material as the second side wall 12. The thickness and strength of the resin material of the strip 32 is selected according to the size of the bag B, as well as the weight of the produce to be packed into it.

The wicket reinforcing strip 32 may also be provided with leaders, or cuts, 40 extending inwardly downwardly from an upper edge 42 opposite the seam 34 in the strip 32. The leaders 40 assist in removal of the bag B from the wicket pins in the packing machine once the bag B is filled. It is to be noted that the leaders or cuts 40 are not formed in the mesh material of the first side wall 10 and are also not formed extending from the wicket holes 30. This location of the leaders 40 affords further increased strength and reliability in the bag B over wicket bags formed completely of fabric mesh.

From the foregoing, it can be seen that bags are provided which exhibit greater reliability during packing in automatic produce packing machines. The bags exhibit better capability of staying on the wickets of the machines as produce is being packed. The bags of the present invention are also less likely to separate from bag material tearing or failure during loading. Space can also be provided with extensions 18 for inclusion of advertising or nutritional value information.

Having described the invention above, various modifications of the techniques, procedures, material, and equipment will be apparent to those in the art. It is intended that all such variations within the scope and spirit of the appended claims be embraced thereby.

We claim:

1. A synthetic resin bag for use with wicket pins of automatic bag filling equipment, comprising:

first and second side walls joined along a bottom portion and two side edges to form the bag;

one of the side walls being formed from a synthetic resin fiber mesh;

one of the side walls being formed of a synthetic resin film;

the side walls being joined together along their vertical extent to form side edges of the bag;

said synthetic resin fiber mesh side wall of the bag having a reinforcing strip of synthetic resin film extending along an upper portion thereof;

the reinforcing strip being joined at a laterally extending seam across the upper portion of the synthetic resin fiber mesh side wall;

the synthetic resin film side wall having a downward extension which is folded upwardly across its lateral extent to lap over and enclose a lower portion of the synthetic resin fiber mesh side wall, the folded upwardly extending portion of the synthetic resin film side wall being secured along a transverse seam across its lateral extent to the mesh in the synthetic resin fiber mesh side wall, the upwardly folded portion of sufficient height to permit a portion of the mesh side wall to extend into a loop formed by the folded portion of the resin film side wall; and said reinforcing strip having holes formed therein for mounting the bag on the wicket pins of the bag filling equipment.

2. The bag of claim 1, further including said reinforcing strip having slits cut therein at a location spaced from the holes to allow for removal of the bag from the filling equipment.

3. The bag of claim 1, wherein the side walls are joined to each other without folding overlap along their vertical side edges.

4. The bag of claim 1, wherein the folded upwardly extending portion of the synthetic resin film side wall is secured along an upper edge portion to the synthetic resin fiber mesh side walls above the bottom of the bag.

5. A synthetic resin bag for use with wicket pins of automatic bag filling equipment, comprising:

first and second side walls;

one of the side walls being formed from a synthetic resin fiber mesh material;

one of the side walls being formed of a synthetic resin film;

the side walls being joined without folding overlap to each other along vertically extending side seams along their lateral side edges;

a reinforcing strip of synthetic resin film extending along an upper edge of the synthetic resin fiber mesh side wall;

the reinforcing strip being joined at a laterally extending seam across the upper edge of the synthetic resin fiber mesh side wall;

the synthetic resin film side wall having a downward extension which is folded upwardly to lap over and enclose a lower portion of the synthetic resin fiber mesh side wall, the upwardly folded overlapping portion of the synthetic resin film side wall being secured to the mesh in the synthetic resin fiber mesh side wall;

the upwardly folded, overlapping portion of the synthetic resin film side wall being joined along vertical side edges to the side walls along their vertical extent;

the upwardly folded portion of sufficient height to permit a portion of the synthetic fiber mesh side wall to extend into a loop formed by the folded portion of the synthetic resin film side wall; and the reinforcing strip having holes formed therein for mounting the bag on the wicket pins of the bag filling equipment.

6. The bag of claim 5, wherein the folded upwardly extending portion of the synthetic resin film side wall is secured along an upper edge portion to the synthetic resin fiber mesh side walls above the bottom of the bag.

7. The bag of claim 6, further including:

the synthetic resin fiber mesh side wall having a portion extending upwardly above the synthetic resin film side wall.

* * * * *